United States Patent [19]

Abernathy et al.

[11] 3,960,085

[45] June 1, 1976

[54] VARIABLE GEOMETRY WARHEAD

[75] Inventors: David D. Abernathy, Fredericksburg, Va.; Herbert D. Adams, Ventura, Calif.; Warren L. Gilbertson, Fredericksburg, Va.; Isaac E. Leonard, III, Margate, N.J.; Denis A. Silvia, King George, Va.

[73] Assignee: The United States of America as represented by the Secretary of the Navy, Washington, D.C.

[22] Filed: May 25, 1967

[21] Appl. No.: 643,298

[52] U.S. Cl. ..... 102/67; 102/58; 102/62; 102/88

[51] Int. Cl.[2] ..... F42B 13/48

[58] Field of Search ..... 102/57, 58, 63, 67 102/68, 62, 88, 91

[56] References Cited

UNITED STATES PATENTS

| | | | |
|---|---|---|---|
| 1,274,419 | 8/1918 | Jackson | 102/58 |
| 2,972,950 | 2/1961 | Welanetz | 102/68 |
| 3,136,251 | 6/1964 | Witow | 102/67 |

*Primary Examiner*—Samuel Feinberg

[57] ABSTRACT

The present invention relates to a warhead in which the full force of the entire weight of explosive can be aimed at the target. The warhead consists of a cylindrical charge which is radially segmented into a plurality of sections hinged together. A target sensing system opens the hinge nearest the target, auxiliary charges unfold the entire warhead with the "kill" side facing the target and the warhead is then detonated.

10 Claims, 9 Drawing Figures

BY

INVENTORS
Herbert D. Adams
David D. Abernathy
Warren L. Gilbertson
Denis A. Silvia
Issac E. Leonard III
BY
ATTORNEY
Lawrence R. Radanovic
AGENT

VARIABLE GEOMETRY WARHEAD

The invention described herein may be manufactured and used by or for the Government of the United States of America for governmental purposes without the payment of any royalties thereon or therefor.

This invention relates generally to a warhead fragmentation system and, more particularly, to a warhead capable of directing substantially all of its kill mechanism and most of the blast to the target area.

In most ordnance devices currently in use, the mass velocity and range of the explosive charge in the warhead is inherently lessened because of the cigar-shape configuration of the device which permits only radial emission of the fragments in all directions from the warhead. Such devices, accordingly, encounter near misses with the target or, because of the freedom of multi-directional fragment emission, a high proportion of the available kill mechanism is directed away from the target with 50% or more of the blast and fragmentation rendered ineffective. In guided missile systems especially, it is not uncommon for an anti-aircraft missile not to make direct contact with the missile. Sensing and proximity systems, therefore, have been devised, usually on the missile, which indicate target proximity and simultaneously command the missile warhead to explode. Again, much of the fragmentation and blast energy is lost for lack of a fragment direction control means. Proposed and prior art directional aiming devices, of one type known to be under consideration, are those which project its kill mechanism only in a forward direction and is designed for head-on missile-to-target encounters. Aiming is normally accomplished by mechanical tilting of the warhead and/or by selective initiation of the warhead's explosive charge. Another design is the group whereby side-on encounters with the target are accomplished. Such a device disperses its kill mechanism 360° about the missile axis, but concentrates the kill in a narrow band about the warhead. Aim is accomplished by shaping the detonation wave through selective, multi-point initiation. Other techniques for controlling direction of warhead fragmentation have included a variation of the warhead's basic shape or the use of electrical means to field-charge the fragments in the direction of the target. Because all of the above-mentioned devices employ a fixed geometrical form, positive fragment control is limited with no or only little increase in range of the fragment particles.

Accordingly, it is an object of the present invention to provide a warhead having increased capability for fragment direction control and wide range of fragment particles over the target area.

Another object of the present invention is to provide a fragmentation warhead device whose shape or geometry is capable of varying just prior to detonation thereby making the explosive charge highly directional and of increased range than has been heretofore possible.

A further object of the present invention is to provide a warhead that can open rapidly from a compact form to an extended form in order to aim the entire kill mechanism and most of the blast into the most probable space location of the target.

A still further object of the present invention is to provide a variable geometry warhead wherein interlinked segments of the device are deployed in a manner that all of its available kill mechanism is exposed to the target with a delay mechanism being simultaneously initiated for firing the warhead booster and directing the entire kill mechanism to the target area.

Other objects, advantages and novel features of the present invention will become apparent from the following detailed description of the invention when considered in conjunction with the accompanying drawings wherein.

Figure 3:
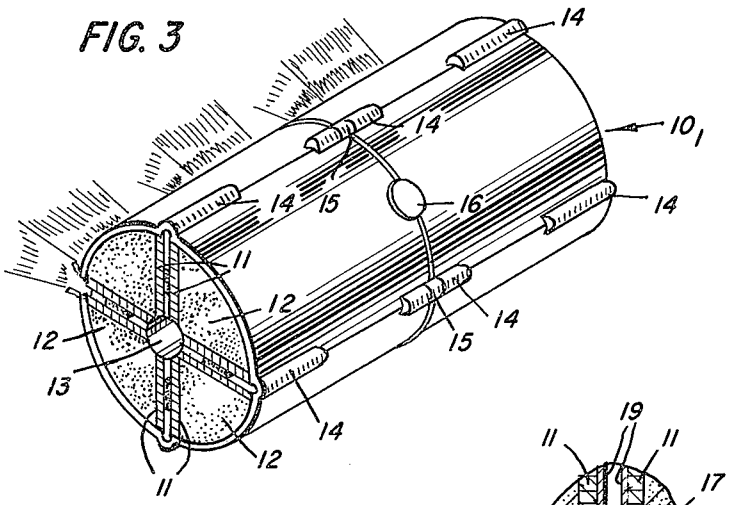
FIG. 3 is a longitudinal perspective of another embodiment according to the invention showing the closed configuration of the warhead.
Figure 3A:
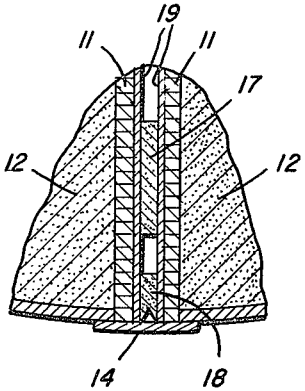
Figure 4:
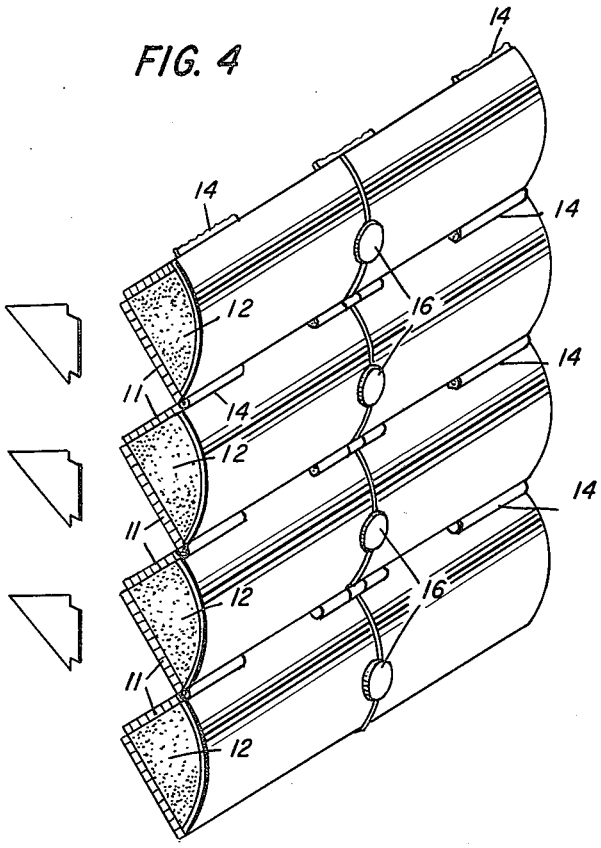
Figure 6:
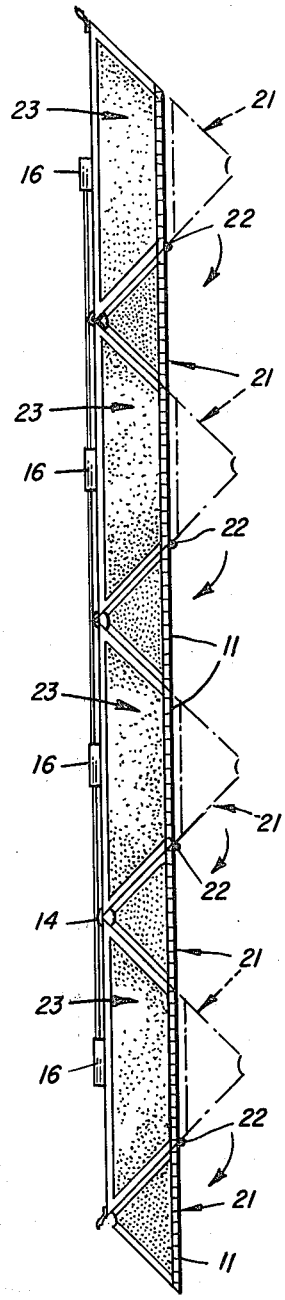
Figure 5:
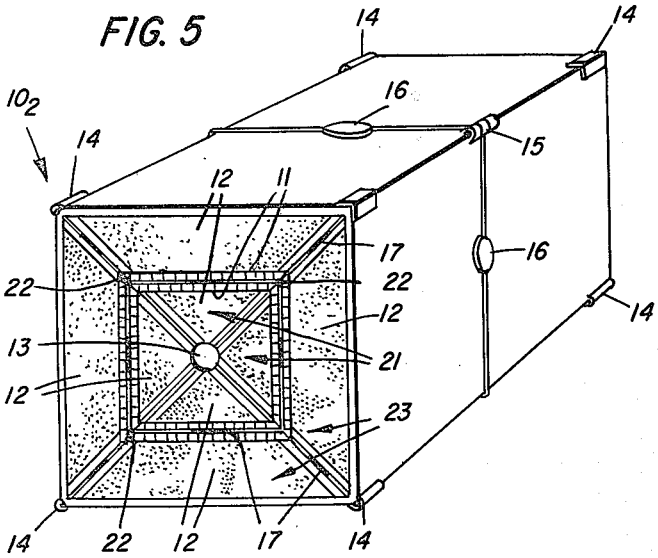
Figure 7:
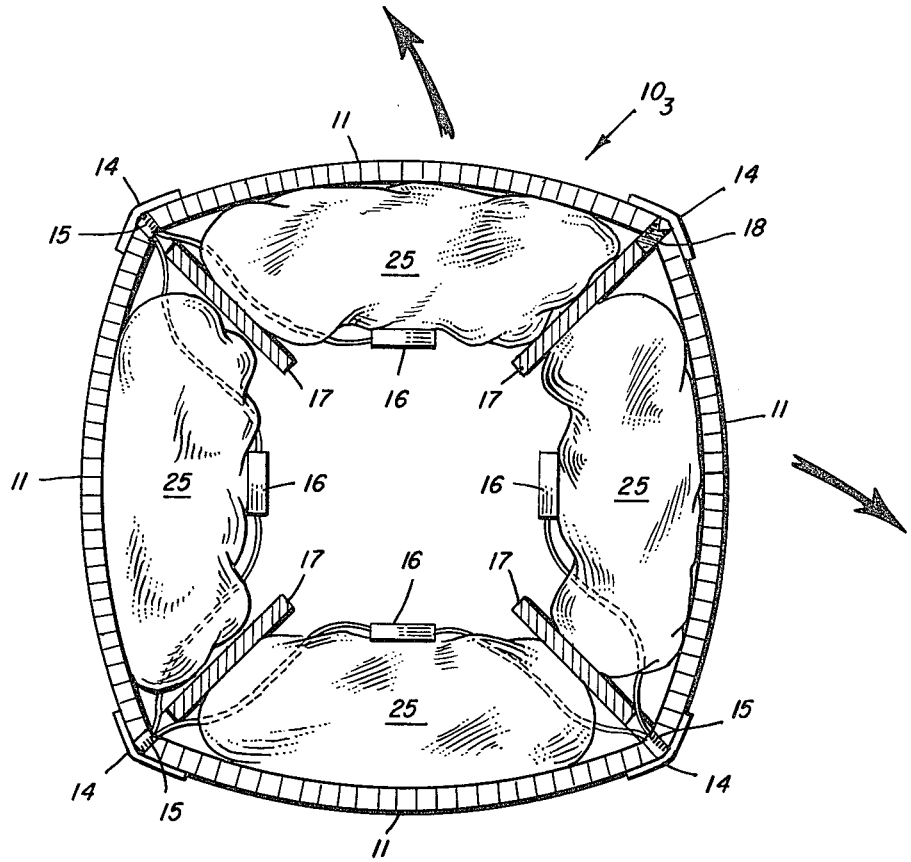

FIG. 3*a* is a detailed view, somewhat enlarged, showing the joint between segments of FIG. 3 embodiment;

FIG. 4 is a perspective view of the FIG. 3 device in its open position after the opening charge has been fired;

FIG. 5 is a third embodiment of the invention in perspective;

FIG. 6 is a view showing the FIG. 5 device in its open position upon opening charge actuation;

FIG. 7 is a showing of a fourth embodiment according to the invention; and

Figure 8:
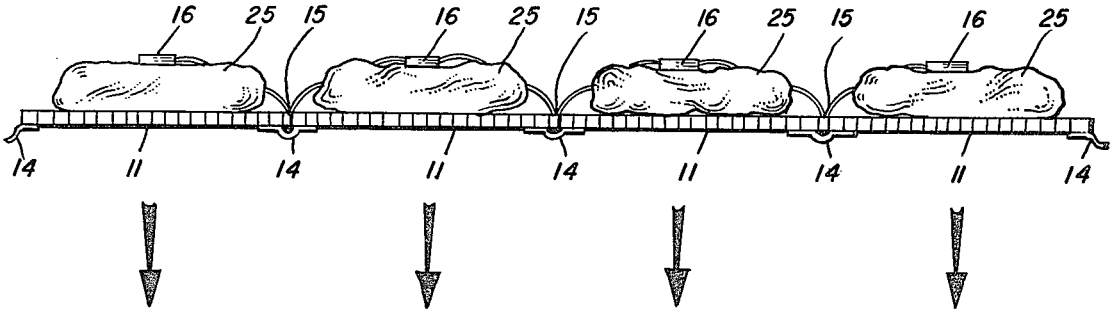

FIG. 8 is a view showing the FIG. 7 device in its open position.

Figure 1:
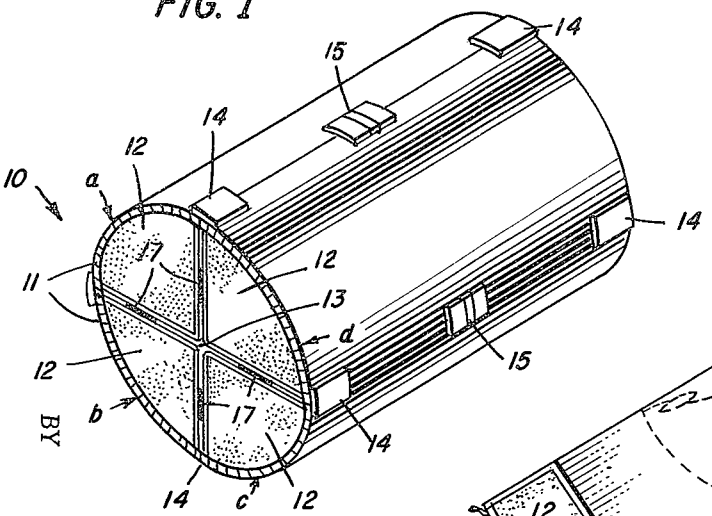
FIG. 1 is a longitudinal perspective of one embodiment of the present invention showing the warhead device in its closed or compact condition.

Referring now to the drawings, wherein like reference characters designate like or corresponding parts throughout the several views, there is shown in FIG. 1 a warhead device 10 which may be any one of a variety of ordance devices including guided weapons, gun launched projectiles and aircraft bombs. The configuration of the device is shown basically cylindrical, it being understood that any triangular or polygonal overall shape would be acceptable without departing from the spirit of the invention. The device 10 is shown divided into four equal segments *a*, *b*, *c* and *d*, each interlinked to the other by means of hinges 14 shown in the drawings to simply be flat plates which bend when subjected to the force of the opening segments. As a part of the center hinge pieces 14, for example, an initiation means 15 is provided which is of the ferro-electric type. The initiation means 15 may be of any ferro-electric composition capable of exhibiting a piezoelectric effect since this element by itself forms no part of the instant invention. The outer casing of the device 10 comprises a kill mechanism 11 of four arcuate sectors joined and interlinked by the hinges 14 to define the cylindrical shape of the device. Each quadrant of the device is occupied by a high explosive 12 of any conventional type with a sheet explosive 17 separating the flat faces of each quadrant and extending longitudinally of the device. Explosive 17 may assume various shapes in cross-section. For example, it may consists of four individual solid sheets as in FIG. 1 or it may consist of two perpendicularly oriented web members each having a pair of spaced longitudinal legs interlinked by cross members, one leg of each pair being disposed between adjacent flat faces of each segment. At each of the eight flat surfaces of the segments, formed by suitable flat, back-up strips for the high explosive, is a booster or detonator 16 as clearly shown in FIG. 2. A linear-shaped charge 18 outboard of each explosive sheet 17 and uniplanar therewith, is associated with each set of hinges.

Figure 2:
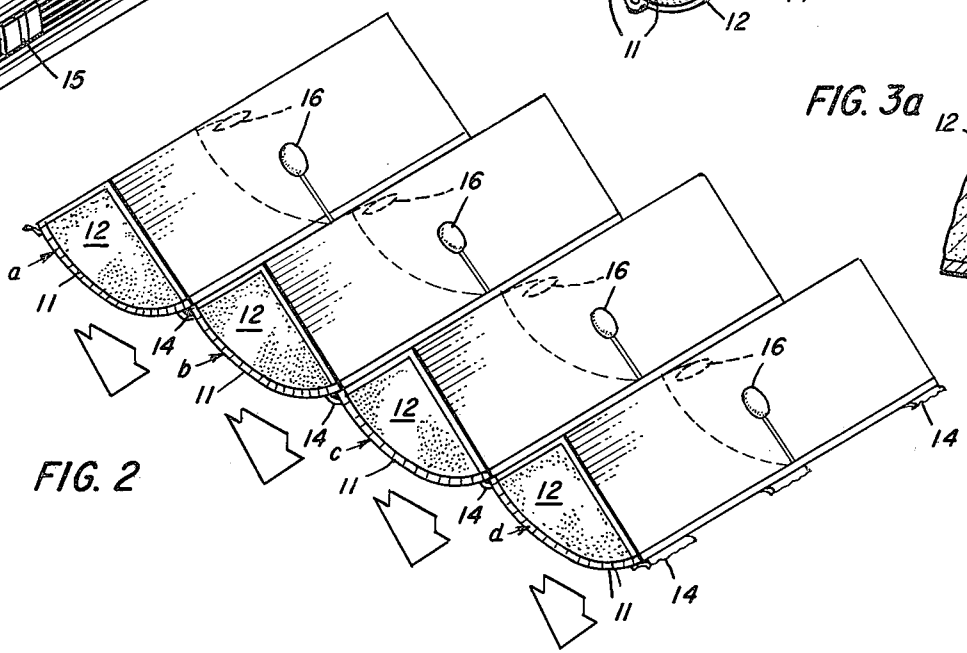
FIG. 2 is a perspective showing of the device in FIG. 1 in its completely open position after a firing of the opening charge.

In operation, the warhead 10 of the present invention is utilized largely in conjunction with a standard air defense missile, the construction of which forms no part of the present invention. The warhead makes use of a means for sensing the presence of a target and its direction from the missile, which sensing means could be missile contained or a part of the missile fire control system on the ground or ship. When the missile is in its terminal stages of flight, and within a predetermined distance of the target, the target direction is sensed by the fire control system. This information is then transmitted to the electrical devices which fire the selected linear shaped charge 18. The hinges 14 fartherest from the target are thereupon cut by their respective shaped charge, which in the embodiment of FIG. 1, are the longitudinally aligned hinges uppermost in the Figure. Simultaneous with the cutting of these hinges, the associated opening charge or explosive sheet 17 is fired for executing the proper opening of the device to that shown in FIG. 2. This opening charge will initially separate segments *a*, *d* with the momentum produced upon opening, causing the remaining segments *b*, *c* to part until the programmed configuration of FIG. 2 is reached. Should explosive sheet webs of the aforementioned type be employed, positive opening of the device is reasonably insured since the firing of one explosive leg thereof, as between segments *a*, *d*, will force these segments apart and, momentarily thereafter, segments *b*, *c* will be forced open due to the firing as transmitted by this web's cross members of the remaining leg disposed therebetween.

Before proceeding with the remaining operative steps, it may be well to note here that, in the device 10, a central, axially aligned conduit 13 is formed at the apices of the segments with its diameter size depending on the extent of the absence of explosive 12 material at each of the apices. The purpose of conduit 13 is, for example, to make available for electrical connection between missile compartments fore and aft of the warhead section. Bulky external connections which may be deleterious to warhead performance are therefore eliminated.

In device 10, a plurality of buffers or attenuators disposed between each flat surface of the segments and at each side of the explosive sheet 17 may also be provided. Such buffers may be composed of any light weight material used conventionally for this purpose sufficient to insulate high explosive 12 from the effect of sheet explosive 17. FIG. 3*a* of the drawings shows a pair of buffers 19 sandwiched about sheet 17 and shaped charge 18 in the same manner as disposed between segments of the device 10 embodiment.

Upon the opening of the device to its full programmed configuration of FIG. 2, the ferro-electric crystals 15 along the segment joints are compressed. A high current, high voltage pulse is thereupon generated by the crystals 15 and transmitted to the detonator-booster assembly 16 disposed along appropriate flat surfaces of the segments. Boosters 16 are thereby made to detonate the main charge 12 for dispersing the kill mechanism 11 substantially in the direction of the arrows shown in FIG. 2. From each arc of the segments, therefore, all of the available kill mechanism 11 is unidirectionally thrown towards the target whereby target impact is reasonably insured. Here, the problem of a waste of particles and energy in the omni-directionally type burst is virtually obviated. Hence, the present invention accomplishes a saving in explosive energy needed for a particular system and an increase in the range and destructiveness of a particular charge. Furthermore, there is a minimization of the danger of shrapnel damage to the carrying vehicle or friendly, nearly personnel located not too far or away from the warhead when it explodes.

Turning now to FIG. 3 of the drawings, there is shown a second embodiment of the invention similar in most respects to the FIG. 1 design, the basic exception being the location of the kill mechanism within the device. Here a variable geometry aimed warhead device $\mathbf{10}_1$ is depicted wherein segmented, thin outer covers, of metal or non-metal, defines the cylindrical shape of the device. The cover comprises four arcuate strips interlinked by means of hinges 14 comprising simple and economical metal plates welded or brazed to each section, similar to that of FIG. 1. Within one of the hinges along each joint is provided the initiator 15 consisting of a ferro-electric crystal of any well-known type which, when compressed, will produce a piezo-electric effect. Between crystals on the outer surface of the cover is the booster or detonator 16 of a simple and lightweight construction commonly known in the art, for example, as the wire bridge type. The distinct difference between this embodiment and that of FIG. 1, lies in the kill mechanism 11 and its location within the device. Here the kill mechanism forms the flat surfaces of each segment so as to collectively give a criss-cross effect when the device is closed. Within the space defined by walls of the kill mechanism and the cover segments, is the high explosive 12 of a type currently used in warheads. Sheet explosive 17, as in the former embodiment, separates each segment of the device, see FIG. 3*a*, by being disposed in between the flat surfaces thereof. A linear-shaped charge 18 or other hinge cutting means is disposed outboard of explosive 17 and in communication with its respective hinges. Buffers or attenuators 19 may be provided wholly along the flat faces of kill mechanism 11 thereby insulating it against the explosive effect of opening charge 17. A centrally disposed, axially aligned conduit 13 may also be formed inward of the segment apices in a manner similar to that hereinbefore noted for device 10. An internal conduit location is therefore available for electrical or other connections between missile compartments for and aft of the warhead. This conduit route could also constitute a strong internal structural frame member resulting in reductions in external missile skin thickness and composition.

Operation of the $\mathbf{10}_1$ device is analogous to that of device 10 hereinabove described, except that on signal from the missile guidance system, the hinges nearest the target are cut by the linear-shaped charge which, in FIG. 3, is leftmost of the device. This side of the warhead will open out through the firing of the opening charge 17 which may be a single solid sheet or web-like as hereinbefore described. When the programmed configuration of FIG. 4 is obtained, crystals 15 are compressed thereby generating a high current, high voltage pulse and transmitting the same to the booster assembly 16 which detonates the main charge 12 and projects the kill mechanism 11 toward the target in the direction of the arrows of FIG. 4. In this embodiment, an increased velocity of the kill mechanism particles has been found to occur because of a bombardment of particles between kill mechanism planes perpendicularly oriented producing a resultant velocity of an increased magnitude.

In FIG. 5, a third embodiment $10_2$ of the invention is shown being substantially square in cross-section in its closed state. It is similar to the $10_1$ device in that the kill mechanism is inward of the device. Four external cover plates interlinked by hinges 14 of the flat metal plate variety define the warhead's external shape. An initiator 15 is located along each joint in the vicinity of one of the hinges with a detonator 16 disposed between initiators 15 on each cover plate. The warhead is again divided into four equal segments each initially triangular in cross-section with the base formed by an outer cover plate. However, unlike the device $10_1$ of FIG. 4, each segment is longitudinally divided as a prism 21 hingedly attached at one end, as at 22, to a truncated prism 23, both of equal height, as clearly shown in FIG. 6. Between prisms 21 and 23 is disposed an opening charge or explosive sheet 17, a buffer or attenuator on each side of the explosive, kill mechanism 11 forming the base of prism 21 and forming the smaller of the parallel surfaces of truncated prism 23. High explosive 12 fills the remaining space of the two prisms of each segment which, of course, are provided with back-up plates for containing the explosive. Opening charge 17 is also disposed between inclined walls of each truncated prism 23 with a hinge cutting means 18 disposed outboard thereof near the hinges as in the previous designs.

In the operation of the device, the aligned hinges 14 nearest the target are cut on a signal from the missile guidance system by the linear-shaped charge 18 or other cutting means associated with the hinges. The opening charge 17 between truncated prisms 23 is simultaneously fired as is opening charge 17 between prisms 21, 23. The last-mentioned opening charge will cause prism 21 to pivot wholly within the space between prisms 23 as shown by the curved arrows in FIG. 6. When the fully opened extent of the device is obtained, crystals 15 are squeezed which generate and transmit pulses to detonators 16 for firing high explosive 12 within prisms 21 and 23. Kill mechanism 11 is thereupon dispersed from an initially uniplanar attitude by the explosive 12 which is wholly therebehind. In this way, the range of blast energy and kill mechanism fragments is increased because of the kill fragment distribution about the warhead.

In FIG. 7, a device $10_3$ is shown similar to the warhead 10 of FIG. 1 in that the fragment case of kill mechanism 11 is equally divided into four equal arcuate segments interlinked by hinges 14 and having an initiator, disposed as in the previous designs, along each joint. An elongated, sausage-like, soft plastic, high explosive unit 25 is associated with each segment. The inner side of each unit is sufficiently elastomeric so as to constrict as in FIG. 7 and stretch when opened as in FIG. 8. A detonator 16 is attached to this side of the unit 25 and an opening charge or explosive sheet 17 is disposed between each unit and sandwiched in between buffers or attenuators so that the plastic explosive units 25 remain unaffected by opening charge 17.

The operation of this device is similar to that of warhead 10 of FIG. 1 with the exception that kill mechanism sheets 11 are permitted to assume a substantially uniplanar attitude when the device is fully opened by reason of the flexibility of plastic units 25. Because these segments are arranged about the exterior of the device, their large radii of curvature requires only a slight bend of segments. The kill mechanism 11 may be located along the inner side of high explosive units 25 in order to effectuate an inside-out opening of the warhead as in FIGS. 3 and 5. The axial, longitudinally extending void with the explosive units permits, as in the afore-described embodiments, electrical or other type connections between missile compartments fore and aft of the warhead section.

Besides controlling the direction of explosion and fragment mass projection, the unique variable geometry warhead of the instant invention relies mainly on its kill mechanism or fragment case in lending structural integrity to the device. Whether the kill mechanism is contained within the device as in FIGS. 3 and 5 or arranged about the exterior of the device as in FIGS. 1 and 7, a multiple purpose is served in replacing, reducing and/or eliminating the need for a strong external structural frame, a strong impulsive load bearing member on the opening surfaces, or large parasitic metal components not part of the kill mechansim. Increased rigidity of the device may also be attained through metal kill device-missile structure combinations not heretofore possible. Furthermore, the use of weighty and bulky attenuators normally required to reduce peak pressure in the main explosive charge is unnecessary since the high explosive is fired only after being separated into a plurality of segments thereby distributing the main charge over a wide area.

The opening charge utilized in the various embodiments of the invention is a thin sheet explosive positioned carefully and appropriately with respect to each segment. In this way, the explosive opening impulses are applied in a controlled, unique manner so as to minimize any unnecessary translational motions of the individual hinged components. Accordingly, the weight of the required opening charge is reduced with a consequent weight of the hinges and cutting mechanism also being reduced. The uncomplicated manner of opening the warhead segments obviates the need for complex pin-type hinges, otherwise necessary, thereby reducing parasitic weight.

The warhead of the instant design is also advantageous from the standpoint of its ferro-electric initiation system which permits precise control of the warhead configuration at the time of initiation, the reason being that, the crystals remain uncompressed until a planar or near-planar configuration of the device is obtained. The piezo-electric type initiator also permits the use of a safer, exploding wire-bridge detonator without the need for auxiliary high voltage power supplies which only add a parasitic power supply weight to the device. Furthermore, the system is inherently safe-arming since electric pulses cannot be generated until compression of the crystals occur at the intended moment of firing.

There are many alternative constructions of the device, any combination of which will have no effect on detracting from the spirit of the invention. For example, any number of explosive prism segments can be useful for certain applications. Also, angled or off-set hinging longitudinally of the device may be employed for effecting wider kill mechanism dispersion or concentration patterns about the warhead. The device could also be hinged to open in a lateral direction after opening longitudinally or the individual shape of each segment can be changed for different dispersion or concentration effects. In addition, hinging and kill mechanism packaging could be located at only the forward or rearward end of the warhead to effect only partial longitudinal opening of the device for specific applications.

In lieu of the ferro-electric type initiation system herein disclosed, a selective timed-multipoint, multi-line or selective timed-delayed combinations may be interchangeably used to suit varying conditions. Also, explosive timing could be achieved through the use of pyrotechnic delay trails or by means of percussion detonators.

The kill mechanism referred to throughout the specification may constitute, for example, a natural fragmenting material with scoring or miniature-shaped charges thereon. Preformed waffle or cubed mats in any number of plies with or without sheet metal layers can be used. Penetrating and cutting fragments can be made to project upon detonation of the main explosive charge through the use of preformed fragment darts or fragments of the self-forging variety. Continuous rod warheads can be kill mechanisms in any of the aforedescribed embodiments for use in projecting a continuous rod into the target path. Also possible for dispersion in an aimed effective pattern are radar screens or windows or chemical and biological warfare agents.

The guided missile which would carry the warhead of the present invention, the missile fire control system used to sense the target, the electrical components in the missile and warhead for causing the detonation of the proper opening charge and the initiation and detonation systems, are of standard design well-known in the art and, as such, form no part of the present invention.

Thus, it becomes evident that the warhead of the instant invention provides a unique and simple method of delivering to a target substantially all of its available kill mechanism with a minimum amount of blast energy and fragmentation waste and over a larger range than has been heretofore possible.

Obviously many modifications and variations of the present invention are possible in the light of the above teachings. It is therefore to be understood that within the scope of the appended claims the invention may be practiced otherwise than as specifically described.

What is claimed is:

1. A warhead device comprising in combination a plurality of initially closed interconnected equal segments forming a uniform geometric body;

booster means;

initiator means;

each of said segments comprising a kill mechanism means and a high explosive charge means in contact therewith; and charge opening means disposed between said segments, whereby a firing of said charge opening means will separate a pair of said segments and expose said kill mechanism to the target at which time said initiator means is actuated for firing said detonator means for detonating said high explosive means and projecting said kill mechanism to the target.

2. The warhead of claim 1 wherein said segments are interconnected by means of hinges and wherein said charge opening means comprises linear-shaped charges for cutting said hinges and first sheet explosives for separating said segments.

3. The warhead of claim 2 wherein said high explosive charge means comprises a high explosive and a backing therefor.

4. The warhead of claim 3 wherein said kill mechanism of each of said segments forms the outer casing of the device.

5. The device of claim 3 wherein said backing forms the outer casing of the device.

6. The device of claim 2 wherein said high explosive charge means comprises units of soft plastic high explosive.

7. The device of claim 4 wherein said initiator means comprises ferro-electric crystals of equal number to that of said segments, said crystals each being disposed at the joint of said segments whereby upon full separation of said segments, said crystals may be compressed for transmitting a high current, high voltage generated pulse to said detonator means.

8. The device of claim 5 wherein said initiator means comprises ferro-electric crystals of equal number to that of said segments, said crystals each being disposed at the joint of said segments whereby upon full separation of said segments, said crystals may be compressed for transmitting a high current, high voltage generated pulse to said detonator means.

9. The device of claim 6 wherein said initiator means comprises ferro-electric crystals of equal number to that of said segments, said crystals each being disposed at the joint of said segments whereby upon full separation of said segments, said crystals may be compressed for transmitting a high current, high voltage generated pulse to said detonator means.

10. The device of claim 2 wherein each of said segments are divided into at least two interconnected sub-segments of equal height, each comprising said kill mechanism means and said high explosive charge means, second sheet explosives disposed between said sub-segments whereby a firing thereof will separate said sub-segments and expose said kill mechanism means of each of said sub-segments to the target.

* * * * *